US012259220B2

(12) United States Patent
Crosnier et al.

(10) Patent No.: US 12,259,220 B2
(45) Date of Patent: Mar. 25, 2025

(54) WEIGHT-BASED DECOY SYSTEM WITH A PATH CONTROLLER

(71) Applicant: Sera Engenierie, Villebon sur Ivette (FR)

(72) Inventors: Francois-Sylvain Crosnier, Voisins le Bretoneux (FR); Rudy Southway, Gif sur Ivette (FR)

(73) Assignee: Sera Engenierie, Villebon sur Ivette (FR)

( * ) Notice: Subject to any disclaimer, the term of this patent is extended or adjusted under 35 U.S.C. 154(b) by 0 days.

(21) Appl. No.: 18/561,326

(22) PCT Filed: May 24, 2022

(86) PCT No.: PCT/EP2022/064099
§ 371 (c)(1),
(2) Date: Nov. 16, 2023

(87) PCT Pub. No.: WO2022/248495
PCT Pub. Date: Dec. 1, 2022

(65) Prior Publication Data

US 2024/0255263 A1 Aug. 1, 2024

(30) Foreign Application Priority Data

May 25, 2021 (FR) ..... 2105187

(51) Int. Cl.
*F41H 11/30* (2011.01)

(52) U.S. Cl.
CPC ..... *F41H 11/30* (2013.01)

(58) Field of Classification Search
CPC ..... F41H 11/12–11/16; F41H 11/20; F41H 11/30
See application file for complete search history.

(56) References Cited

U.S. PATENT DOCUMENTS 5,313,868 A * 5/1994 Wolf ..... F41H 11/30 89/1.13
5,712,441 A * 1/1998 Grunewald ..... F41H 11/16 89/1.13
6,026,135 A * 2/2000 McFee ..... F41H 11/12 376/159

(Continued)

FOREIGN PATENT DOCUMENTS

CN 111981911 11/2020
EP 2133652 12/2009

(Continued)

*Primary Examiner* — Joshua E Freeman
(74) *Attorney, Agent, or Firm* — Defillo & Associates, Inc.; Evelyn A. Defillo

(57) ABSTRACT

Method and device for steering a convoy (1) having a follower vehicle (2) to be protected and a weight-based decoy system (4), this method and these device being relative to the following steps: steering a controller of yaw-wise direction of the weight-based decoy system (4) depending on a route to follow, the weight-based decoy system (4) defining a safe track that is made so by passage of at least one axle-and-wheels assembly (5) suitable for exerting pressure on the ground; steering the follower vehicle (2) so that its wheels follow a path that falls on the safe track defined by the weight-based decoy system (4).

16 Claims, 8 Drawing Sheets

(56) References Cited

U.S. PATENT DOCUMENTS

| | | | | |
|---|---|---|---|---|
| 9,834,124 | B2 * | 12/2017 | Pons | B62D 53/00 |
| 10,168,126 | B2 * | 1/2019 | Cronk | F41H 7/02 |
| 11,060,826 | B1 * | 7/2021 | Croom | F41H 11/30 |
| 11,199,382 | B1 * | 12/2021 | Bride | F41H 11/30 |
| 11,221,196 | B2 * | 1/2022 | Babu | F41H 11/136 |
| 2004/0035285 | A1 * | 2/2004 | Renwick | F41H 11/30 89/1.13 |
| 2011/0232468 | A1 * | 9/2011 | Hembise | F41H 11/16 89/1.13 |
| 2012/0000350 | A1 * | 1/2012 | Hubert-Habart | F41H 11/32 89/1.13 |
| 2012/0186421 | A1 * | 7/2012 | Firth | F41H 11/30 89/1.13 |
| 2013/0327203 | A1 * | 12/2013 | Cronk | F41H 11/30 89/1.13 |
| 2014/0157975 | A1 * | 6/2014 | Firth | F41H 11/30 89/1.13 |
| 2015/0362295 | A1 * | 12/2015 | Bradley | F41H 11/30 89/1.13 |
| 2016/0245623 | A1 * | 8/2016 | Nelson | G01V 3/104 |
| 2018/0100394 | A1 * | 4/2018 | Baiden | F42D 3/04 |
| 2020/0033468 | A1 * | 1/2020 | Stanley | G01S 13/931 |
| 2021/0269029 | A1 * | 9/2021 | Fendt | B60W 60/001 |
| 2021/0304618 | A1 * | 9/2021 | Okuyama | G05D 1/0295 |
| 2021/0354753 | A1 * | 11/2021 | Micaelli | B62D 12/02 |

FOREIGN PATENT DOCUMENTS

| | | |
|---|---|---|
| EP | 2299233 | 3/2011 |
| EP | 2327951 | 6/2011 |
| EP | 2672218 | 12/2013 |
| WO | WO200203007 | 1/2002 |
| WO | WO2012080719 | 6/2012 |

* cited by examiner

WEIGHT-BASED DECOY SYSTEM WITH A PATH CONTROLLER

CROSS REFERENCE TO RELATED APPLICATION

This application is a national stage entry of PCT/EP2022/064099 filed May 24, 2022, under the International Convention and claiming priority over French Patent Application No. FR2105187 filed May 25, 2021.

TECHNICAL FIELD

The invention relates to the field of defensive devices intended to protect a vehicle against hazards present in the ground, notably explosive devices. The invention more particularly relates to a weight-based mine-clearing system, which is to say a system intended to be coupled to a vehicle that is to be protected, and that is designed to apply pressure to the ground, ahead of the vehicle, in order to trigger any explosive devices that may be present in the path of the vehicle that is to be protected.

Weight-based mine-clearing systems generally comprise a chassis coupled to the front of a vehicle that is to be protected and equipped with a wheelset for applying pressure to the ground.

PRIOR ART

Anti-personnel mines and anti-tank mines, improvised explosive devices (IEDs) and, in general, any type of explosive device triggered by the passage of a vehicle, constitute a threat to vehicles that have to follow itineraries where such explosive devices might be found.

Weight-based mine-clearing systems are means of guarding against this threat. Weight-based mine-clearing systems are generally arranged ahead of a following vehicle that is to be protected and are usually equipped with wheels which, when they pass over the sensing elements, trigger the explosive device.

The wheels of the weight-based mine-clearing system are tasked with activating the explosive devices and need to be placed as far ahead as possible in order to keep the following vehicle as far as possible away from the point at which the explosive device triggered by the mine-clearing device explodes.

This type of system appeared as early as the First World War and was developed during the Second World War.

The most recent embodiments have improved these systems by replacing the metal rollers with rows of wheels of automotive or construction-plant origin. All of these recent embodiments use the wheels that are suspended so as to improve the terrain-following as the vehicle moves.

Numerous solutions as to how to control the steering of the weight-based mine-clearing system on the basis of information acquired on the steering system of the following vehicle or on the weight-based mine-clearing system itself have been conceived and patented (see for example patent application EP2133652).

All of these solutions share the disadvantage that the greater the distance between the wheelset of the mine-clearing system and the front wheelset of the following vehicle, the later the steering of the weight-based mine-clearing system occurs. Yet it is this distance that keeps the following vehicle safe. The prior art requires a compromise between this distance and the mine-clearing performance.

The result of this compromise is that, on entering and exiting a bend, there is a risk that explosive devices may lie in zones not made safe by the weight-based mine-clearing system. In order to reduce the magnitude of these zones that have not been made safe, it would be necessary to reduce the space between the wheelset of the weight-based mine-clearing system and the following vehicle, and this would necessarily reduce the distance between the vehicle and a possible explosion.

Patent application EP2327951 proposes another way of managing the steering of the weight-based mine-clearing system. It uses the (yaw) steering angle of the rollers of the system with respect to its structure to manage the steering of the structure of the weight-based mine-clearing system with respect to the following vehicle. This solution may offer advantages in certain situations, but does not change the disadvantage described hereinabove.

This problem of making the entries and exits of a bend safe is therefore not taken into consideration by the prior art, with the risk that those laying explosive devices may exploit this systematic shortcoming.

SUMMARY OF THE INVENTION

It is the objective of the invention to improve the weight-based mine-clearing means of the prior art.

To this end, the invention is aimed at a method for steering a convoy comprising a following vehicle that is to be protected and a weight-based mine-clearing system, this method comprising the following steps:

steering a yaw-direction steering command of the weight-based mine-clearing system on the basis of a route that is to be followed, the weight-based mine-clearing system defining a lane that has been made safe by the passage of at least one wheelset designed to apply pressure to the ground;

steering the following vehicle in such a way that its wheels follow a path that falls inside said safe lane defined by the weight-based mine-clearing system.

In another subject matter, the invention is aimed at a weight-based mine-clearing system intended to protect the following vehicle, this weight-based mine-clearing system comprising at least one wheelset designed to apply pressure to the ground so as to define a lane that has been made safe, this weight-based mine-clearing system comprising:

a chassis on which the wheelset is mounted;

means for commanding the yaw-direction steering of the weight-based mine-clearing system.

In this weight-based mine-clearing system, the means for commanding the yaw-direction steering of the weight-based mine-clearing system are designed to direct the weight-based mine-clearing system according to a route that is to be followed.

In another subject matter, the invention is aimed at a convoy comprising a following vehicle that is to be protected and a weight-based mine-clearing system as described above. In this convoy, the means for commanding the yaw-direction steering of the weight-based mine-clearing system comprise a steering computer designed to steer the weight-based mine-clearing system to the yaw-direction steering command according to a route that is to be followed.

The expression "yaw-direction (steering)" refers here, in the conventional way, to the action of turning the steering of the relevant rolling body, namely to the action that causes said body to rotate about an axis perpendicular to the plane on which it is running.

The term "wheel" is to be considered here in its broadest sense to encompass wheels, wheel-track sets and mechanical devices allowing running, etc.

The invention guarantees first of all exact correspondence between the path followed by the weight-based mine-clearing system, which defines a lane that is made safe, and the path of the following vehicle that is to be protected.

The following vehicle is thus guaranteed to travel exclusively in the lane that has been made safe by the weight-based mine-clearing system, whatever the complexity of the path and irrespective of the bends and sequence of bends.

The path of the convoy is given by the steering (direction) of the weight-based mine-clearing system, and the vehicle is steered to travel within the lane that has been made safe, so that there are no zones that have not been made safe and in which any explosive device present has not been cleared by the mine-clearing.

The distance between the weight-based mine-clearing system and the following vehicle can thus be maximized in order to increase safety without degrading the mine-clearing performance. The width of the wheelsets of the weight-based mine-clearing system can also be reduced to tally more closely with the width of the wheels of the following vehicle because the path followed by the wheels of the following vehicle falls within the lane that has been made safe.

The invention moreover makes it possible to relieve the driver of some of the vigilance required compared with the state of vigilance required by most of the systems of the prior art in which the driver may have to manage multiple positioning commands regarding the following vehicle they are driving and also regarding the weight-based mine-clearing system itself, as well as regarding the means of articulation between the following vehicle and the weight-based mine-clearing system. The invention allows the driver to concentrate only on controlling one element.

Relieving the driver of some of the vigilance required is actually of key importance in this type of application where any spare attention can be used to observe the (by definition hostile) environment thus enhancing the safety of the convoy.

Moreover, the invention can be readily fitted to existing vehicles, at least in some of its configurations, thus making it possible to produce weight-based mine-clearing systems that can be fitted to existing vehicles. The ability to update existing fleets of vehicles, at low cost and with simplified in-field logistics is of key importance in military applications.

The invention also lends itself to partial or full automation, easily and at low cost.

The invention is moreover compatible with any type of weight-based mine-clearing system so far as the path-command means are concerned. Specifically, weight-based mine-clearing systems are generally steered so far as their yaw-direction path is concerned, using means such as:

- a chassis that is fixed or articulated with respect to the following vehicle and wheelsets with steered direction-controlling wheels mounted on the chassis;
- a chassis articulated with respect to the following vehicle and the orientation of which is commanded by rams, and wheelsets the wheels of which turn freely in yaw;
- a combination of the two preceding means.

All these types of weight-based mine-clearing system architecture are compatible with the invention.

The method according to the invention may comprise the following additional features, alone or in combination:

- the step of steering a yaw-direction command of the weight-based mine-clearing system is performed by a steering computer determining said route to be followed;
- the yaw-direction steering command of the weight-based mine-clearing system is executed by a steering actuator connected to the steering computer;
- the steering computer determines the route that is to be followed on the basis of an environmental factor;
- said environmental factor is the configuration of a pathway;
- said environmental factor is a line drawn on the ground;
- the step of steering the following vehicle is performed by a driver of the following vehicle;
- the driver of the following vehicle steers only the following vehicle;
- the step of steering the following vehicle comprises a step of commanding the yaw direction of the following vehicle, this being achieved by a steering actuator of the following vehicle, this steering actuator being commanded by a steering computer designed to steer the path of the following vehicle so that the wheels of the following vehicle fall inside the safe lane defined by the weight-based mine-clearing system;
- the steering computer is connected to at least one environment sensor of the following vehicle;
- the step of steering a yaw-direction command of the weight-based mine-clearing system is performed from the following vehicle by a driver of the following vehicle;
- the step of steering the following vehicle comprises a step of commanding the yaw direction of the following vehicle, this being achieved by a steering actuator of the following vehicle, commanded by a steering computer designed to steer the path of the following vehicle so that the wheels of the following vehicle fall inside the safe lane defined by the weight-based mine-clearing system.

The convoy according to the invention may comprise the following additional features, alone or in combination:

- the steering computer is designed to determine the route that is to be followed on the basis of an environmental factor;
- the weight-based mine-clearing system comprises at least one environment sensor connected to the steering computer;
- the environment sensor is designed to determine the configuration of a pathway;
- the environment sensor is designed to identify a line drawn on the ground;
- the following vehicle comprises manual steering-control means designed so that a driver of the following vehicle can command a yaw direction of the following vehicle;
- the following vehicle comprises a steering actuator commanded by a steering computer designed to steer the path of the following vehicle so that the wheels of the following vehicle fall inside the safe lane defined by the weight-based mine-clearing system;
- the following vehicle comprises at least one environment sensor connected to the steering computer;
- the means for commanding the yaw direction of the weight-based mine-clearing system comprise a steering actuator designed for commanding the yaw-direction of the weight-based mine-clearing system from the following vehicle;

the following vehicle comprises manual means for commanding said steering actuator of the weight-based mine-clearing system;

the following vehicle comprises a steering actuator commanded by a steering computer designed to steer the path of the following vehicle so that the wheels of the following vehicle fall inside the safe lane defined by the weight-based mine-clearing system;

the following vehicle comprises: a first steering wheel constituting the manual means for commanding said steering actuator of the weight-based mine-clearing system; a second steering wheel designed for taking control of the steering actuator of the following vehicle.

BRIEF DESCRIPTION OF THE FIGURES

Further features and advantages of the invention will become apparent from the nonlimiting description that follows, given with reference to the attached drawings, in which.

Elements that are similar and common to the various embodiments bear the same reference numerals referring to the figures.

DETAILED DESCRIPTION OF THE INVENTION

Figure 1:
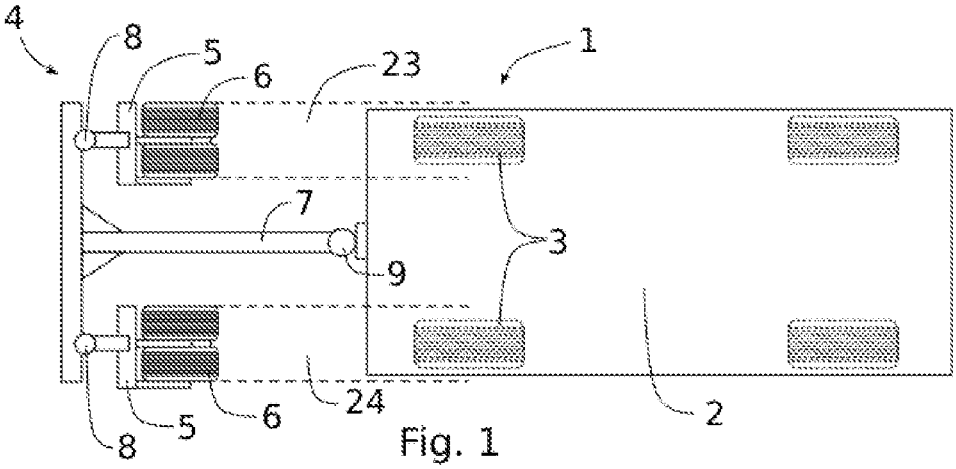
FIG. 1 is a schematic view from above of a convoy involving a weight-based mine-clearing.

FIG. 1 illustrates one example of the overall structure of a convoy 1 involving a weight-based mine-clearing.

This convoy 1 is made up of a following vehicle 2, in this instance comprising four wheels, the two front wheels 3 being steered direction-controlling wheels. This following vehicle 2 is intended to be protected from hazards hidden in the ground, in the context of the application of the invention. To this end, the convoy 1 comprises a weight-based mine-clearing system 4 coupled to the front of the following vehicle 2.

The weight-based mine-clearing system 4 comprises rolling means for applying pressure to the ground ahead of the following vehicle 2 so as to trigger any explosive devices encountered, thus sparing the following vehicle 2 from the explosion. The distance between the rolling means that apply pressure to the ground and the front of the following vehicle 2 therefore needs to be great enough for the following vehicle 2 to be kept sufficiently distant at the moment of the explosion. According to the invention, this distance does not penalize the mine-clearing performance and can therefore be maximized.

In the present example, the rolling means for applying pressure to the ground consist of two wheelsets 5 each comprising two wheels 6. The weight-based mine-clearing system 4 additionally comprises a chassis 7 on which the wheelsets 5 are articulated, each by means of a vertical-axis pivot 8 allowing the wheels of the wheelsets 5 to pivot in yaw.

The chassis 7 is connected to the following vehicle 2 by a vertical-axis pivot 9, allowing the chassis 7 to pivot in yaw.

In the known way, the wheels 6 of the wheelsets 5 are weighty enough that the pressure they apply to the ground is compatible with the desired function of triggering an explosive device, and are mounted on suspensions which may potentially comprise known pressure equalizers.

Figure 2:
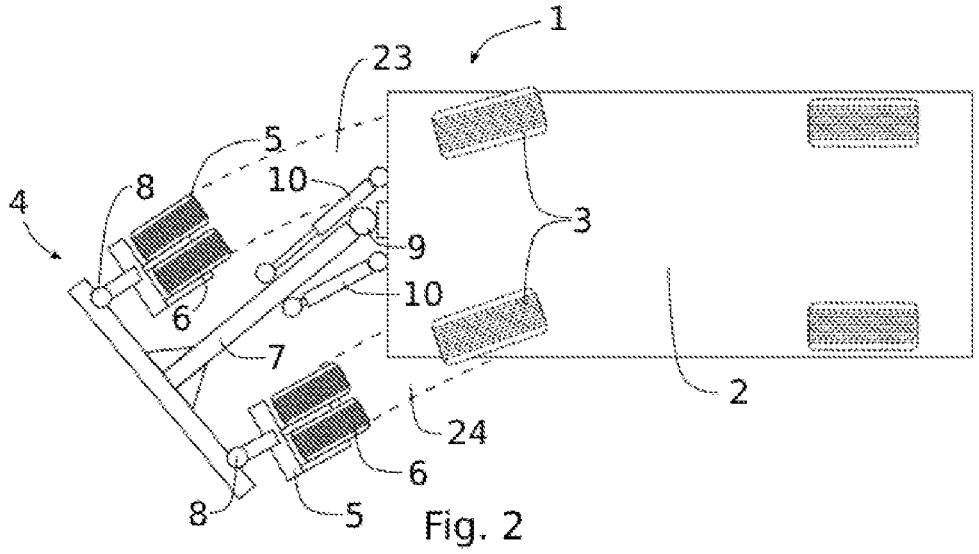
FIG. 2 is a view of the convoy of FIG. 1 according to a first variant.
Figure 3:
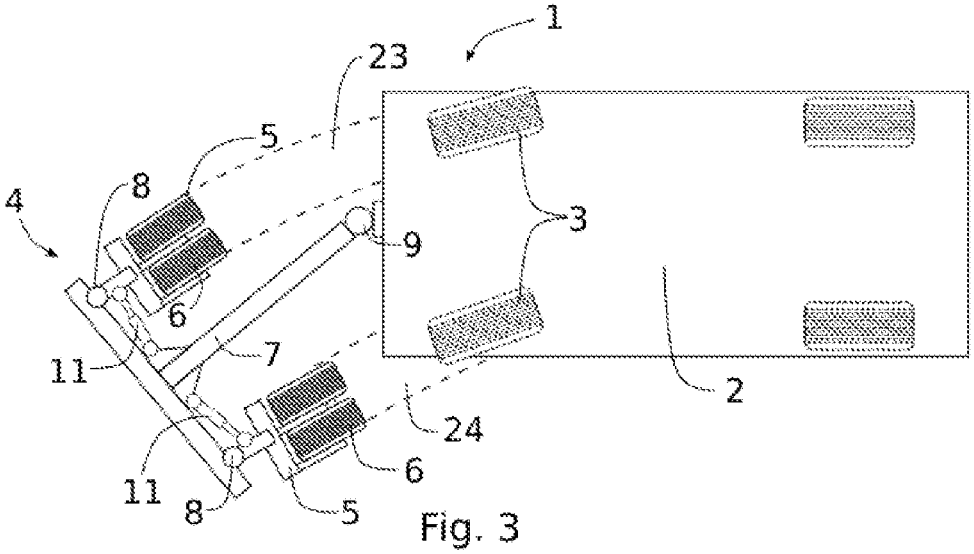
FIG. 3 is a view of the convoy of FIG. 1 according to a second variant.

FIGS. 2 and 3 illustrate the overall architecture of the convoy 1 of FIG. 1 according to two variants relating to how the yaw-direction steering of the weight-based mine-clearing system 4 is commanded.

FIG. 2 illustrates a first variant in which the yaw-direction steering of the weight-based mine-clearing system 4 is commanded by commanding the pivoting of the chassis 7 with respect to the following vehicle 2, using one or more steering actuators 10. The steering actuators 10 allow the chassis 7 to be pivoted about the pivot 9. The steering actuators 10 may for example be hydraulic or electric rams.

FIG. 2 depicts the convoy 1 in the process of negotiating a bend.

The pivot 8 is a free pivot, which is to say a pivot that allows the wheelsets 5 the behaviour of wheels able to turn freely in yaw. The wheelsets 5 may pivot freely in yaw (within the limits of their permitted angular travel) and thus naturally follow the pivoting movements of the chassis 7.

The cornering maneuvers of the convoy 1 are executed by pivoting the chassis 7 about the pivot 9 using the steering actuators 10, the wheelsets 5 orienting themselves, and then the wheels 3 of the following vehicle 2 are commanded to turn in the yaw direction in order to fall inside the lane made safe by the wheelsets 5.

FIG. 3 is a view similar to FIG. 2 and in which the convoy 1 is likewise negotiating a bend, for a second variant as to how the yaw-direction steering of the weight-based mine-clearing system is commanded. According to this variant, the yaw-direction steering of the weight-based mine-clearing system 4 is commanded by one or more steering actuators 11 (such as hydraulic or electric rams) designed to command the angular position, in the yaw direction, of the wheelsets 5 with respect to the chassis 7. The pivot 9 is itself free, which is to say that the chassis 7 can pivot freely with respect to the following vehicle 2, within its permitted angular travel.

According to this variant of FIG. 3, the yaw-direction steering of the following vehicle 2 is commanded in the same way as for the variant of FIG. 2, whereas the steering of the weight-based mine-clearing system 4 is steered beforehand by commanding the steering actuators 11 which cause the wheelsets 5 to pivot in the yaw direction thus causing the chassis 7 to move in a steering direction.

The invention applies to both variants of commanding the steering of the weight-based mine-clearing system 4 of FIGS. 2 and 3, which variants have been given here by way of example, as well as to any other way of steering the weight-based mine-clearing system 4 in the yaw direction, notably a combination of the two variants explained.

The structure and operation of the convoy 1 and of the weight-based mine-clearing system 4 according to the invention are described in detail with reference to FIGS. 4 to 8.

Figure 4:
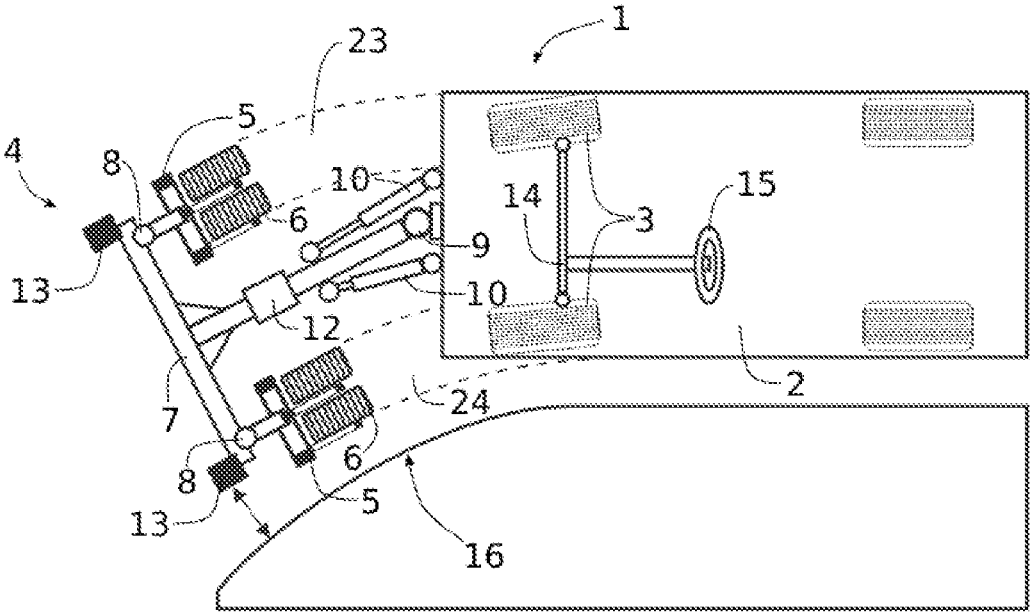
FIG. 4 illustrates a convoy according to a first embodiment of the invention.
Figure 5:
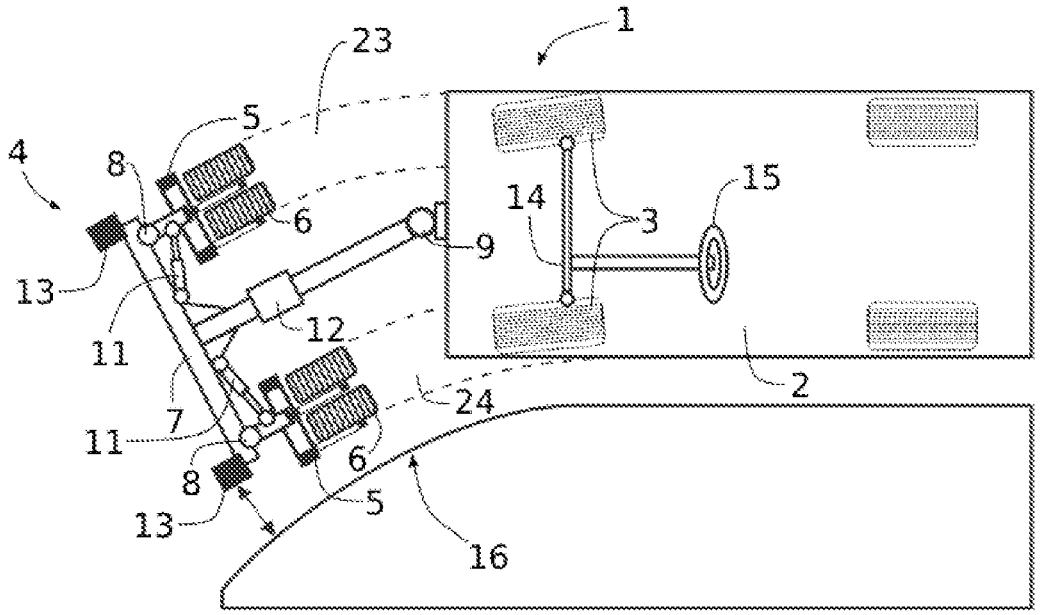
FIG. 5 illustrates a variant of the convoy of FIG. 4.

According to a first embodiment illustrated in FIGS. 4 and 5, the weight-based mine-clearing system 4 behaves like an autonomous vehicle and, insofar as its yaw-direction steering is concerned, it follows its own route completely or partially autonomously. The driver of the following vehicle 2 drives only their own vehicle, ensuring that the following vehicle 2 follows the lane made safe by the weight-based mine-clearing system 4. More specifically, the driver takes care to ensure that the wheels of the following vehicle 2 fall within the lane made safe by the weight-based mine-clearing system 4. In this example, the lane made safe extends in two strips 23, 24 corresponding to the path of the two wheelsets 5, the right-hand wheels of the following vehicle 2 falling within the strip 23 and the left-hand wheels of the following vehicle falling within the other strip 24.

The driver of the following vehicle 2 thus controls the rate of advance (acceleration, speed, braking) of the following vehicle 2, and therefore the rate of advance of the convoy 1 as a whole, and the weight-based mine-clearing system 4 steers its own yaw direction and therefore the yaw direction of the convoy 1 as a whole. The role of the driver of the following vehicle 2, as far as yaw-direction commands are concerned, is reduced to following the strips 23, 24.

In FIG. 4, the weight-based mine-clearing system 4 comprises means for commanding the yaw-direction steering corresponding to the variant of FIG. 2.

The weight-based mine-clearing system 4 comprises a steering computer 12 designed to collect information about the environment of the weight-based mine-clearing system 4 in order to determine the route to follow. This steering computer 12 controls the steering actuators 10 in order to influence the yaw direction adopted by the weight-based mine-clearing system 4.

The steering computer 12 is also connected to environment sensors 13 fixed to the chassis 7 and able to capture one or more parameters pertaining to the external environment so as to allow the steering computer 12 to determine the route to follow.

Any currently-known solution in the field of autonomous vehicles can be implemented for thus allowing the steering computer 12 to direct the weight-based mine-clearing system 4 on the basis of the information from the environment sensors 13. In the present example, the environment sensors 13 are able to discern the configuration of a pathway by detecting the edge 16 of a defined route (it being possible for this edge 16 to be embodied by barriers, hedges, etc.). These environment sensors 13 may be optical sensors, infrared sensors, ultrasound, laser, radar, lidar, etc. sensors.

The environment sensors 13 and the associated signal processing may consist of any known means from the prior art of autonomous vehicles or robots. In particular, the environment sensors 13 may be designed to follow a route drawn out on the ground beforehand, for example by a line of paint applied beforehand, or visible or radioelectric marker posts. This arrangement may of course be supplemented by any other factor known from the field of autonomous vehicles, such as positioning and navigation software, etc.

These means that allow a vehicle to follow a route autonomously are known from elsewhere and will not be described in greater detail here. These means are therefore applied here to the weight-based mine-clearing system 4 so that its yaw direction can be steered autonomously.

Whereas the weight-based mine-clearing system 4 is arranged as an autonomous vehicle (apart from the fact that it is coupled to the following vehicle 2), the following vehicle 2 remains a conventional vehicle with yaw-direction steering means available to the driver. The following vehicle comprises for example a conventional steering device 14, consisting for example of a steering rack commanded by a steering wheel 15 and acting on the steering angle of the steered direction-controlling wheels 3.

This embodiment is particularly advantageous in the case of a retrofit to a fleet of existing vehicles in order to update same. The following vehicles 2 require no modification, simply the fitting of a new weight-based mine-clearing system 4 according to the invention.

Although the following vehicle 2 is not modified in any way, it is used in a substantially different way from the prior art. The driver effectively drives the following vehicle 2, relieved of the need to choose the route to follow.

The driver of the following vehicle 2 therefore acts on the steering wheel 15 only to steer their own vehicle so that their wheels fall within the safe lane 23, 24 defined by the weight-based mine-clearing system 4. In concrete terms, in the present example in which the weight-based mine-clearing system 4 comprises two wheelsets 5, the driver of the following vehicle 2 acts on the steering wheel 15 only to bring the wheels of their own vehicle 2 into the wheeltracks of the wheelsets 5 of the weight-based mine-clearing system 4. The driver of the following vehicle 2 is thus relieved both of managing the weight-based mine-clearing system 4 and of managing the route to follow. The simple task of keeping the wheels of the following vehicle 2 in the wheeltracks already made by the wheelsets 5 while managing the rate of advance of the convoy frees up some of the attention of the driver who can then also be attentive to other operational aspects of the mission of the convoy 1 and to the environment in general.

When use of the weight-based mine-clearing system is not required (outside of the danger zones), the convoy 1 may offer a mode of operation in which the weight-based mine-clearing system 4 is deactivated, the position of the chassis 7 is locked and the following vehicle 2 is then driven in the conventional way without using the weight-based mine-clearing system.

FIG. 5 illustrates the same embodiment as FIG. 4, but for the variant whereby the yaw direction of the weight-based mine-clearing system 4 is commanded in the way corresponding to FIG. 3. In this variant, the steering computer 12, still connected to the environment sensors 13, here acts on the steering actuators 11 which modify the steering angle of the wheelsets 5.

In this variant, the weight-based mine-clearing system 4 likewise follows its route like an autonomous vehicle, in the same way as for the variant of FIG. 4, with the same possibilities. The only thing that varies is the way in which the yaw direction of the weight-based mine-clearing system 4 is commanded.

The driver of the following vehicle 2 acts on the steering wheel 15 as described previously, in order to keep the wheels of the following vehicle 2 in the wheeltracks of the wheelsets 5.

Figure 6:
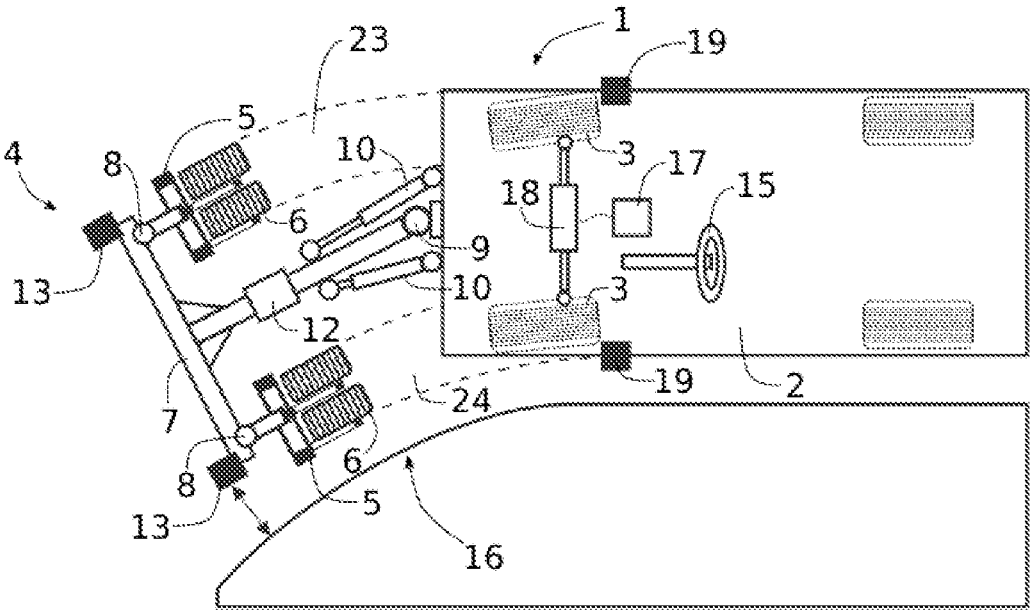
FIG. 6 illustrates a convoy according to a second embodiment of the invention.

FIG. 6 illustrates a second embodiment in which the weight-based mine-clearing system 4 behaves like an autonomous vehicle in the same way as for the first embodiment, thanks to its steering computer 12 connected to the environment sensors 13 and to the actuators 10 for controlling the yaw-direction steering of the weight-based mine-clearing system 4.

However, according to this second embodiment, the following vehicle 2 additionally comprises a steering computer 17 controlling a steering actuator 18 for the following vehicle 2. The steering computer 17 may thus control the yaw-direction steering of the following vehicle 2.

According to this second embodiment, the following vehicle 2 is steered so that its path is contained within the lane made safe by the weight-based mine-clearing system 4. Here, vehicle control is achieved, so far as the yaw-direction steering is concerned, without the intervention of the driver of the following vehicle 2.

The steering computer 17 of the vehicle 2 may be connected to the steering computer 12 of the weight-based mine-clearing system 4 for transmitting path information.

The steering computer 17 may moreover benefit from any arrangement known in the field of autonomous vehicles to enable it to cause the following vehicle 2 to follow a path that falls within the lane made safe by the weight-based mine-clearing system 4 so that the steering angle of the steered direction-controlling wheels 3 cause these wheels to fall inside the strips 23, 24 of the safe lane.

The steering computer 17 may additionally be connected to its own environment sensors 19 mounted on the following vehicle 2, and to any other element that ensures its autonomy (so far as the yaw-direction steering is concerned).

According to this embodiment, the driver of the following vehicle 2 manages only the rate of advance of the vehicle (acceleration, speed, braking). The driver has even more of their attention free for other observations relating to the current mission.

The steering wheel 15 is, however, always available to the driver of the following vehicle 2 who may act at any moment and take back control of the steering computer 17 of the following vehicle 2, if need be. The steering computer 17 is for example connected to a sensor that detects the action on the steering wheel and triggers the stopping of the automatic commanding of the steering of the vehicle in order to leave the yaw-direction steering of the following vehicle 2 to the driver again.

This second embodiment may of course, just like the first embodiment, also be implemented with the variant corresponding to FIG. 3 as to how the yaw-direction steering of the weight-based mine-clearing system 4 is commanded.

Figure 7:
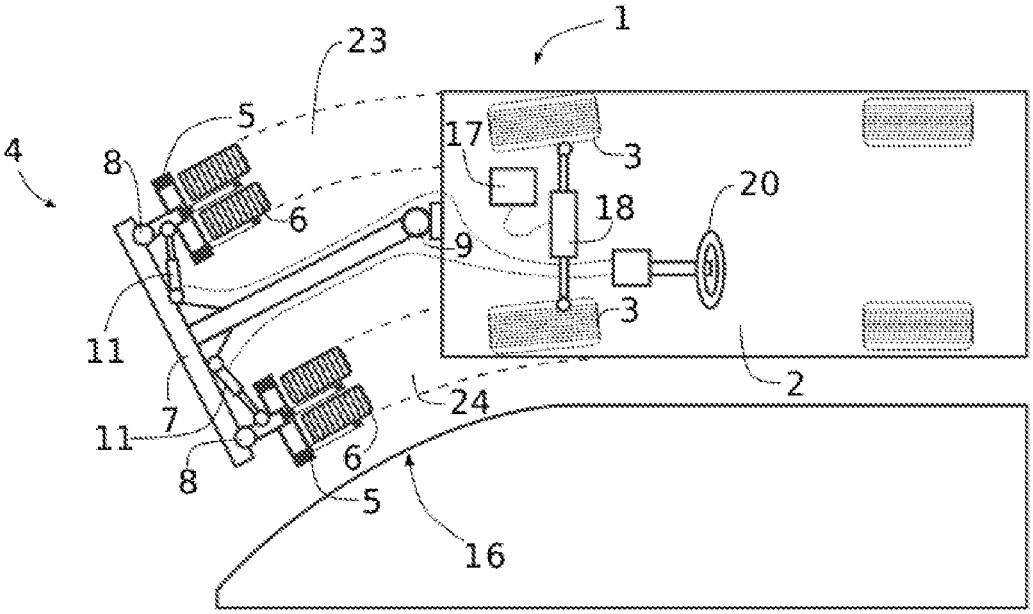
FIG. 7 illustrates a convoy according to a third embodiment of the invention.

FIG. 7 illustrates a third embodiment of the invention in which the driver of the following vehicle 2 directly controls the yaw-direction steering of the weight-based mine-clearing system 4.

The example of FIG. 7 relates to the variant corresponding to FIG. 3 as to how the yaw-direction steering of the weight-based mine-clearing system 4 is controlled.

According to this third embodiment, the weight-based mine-clearing system 4 is simplified and its steering is not automated. The following vehicle 2 comprises a steering wheel 20 acting directly on the steering actuators 11 of the weight-based mine-clearing system 4. The steering wheel 20 may for example be connected by hydraulic hoses to the actuators 11 which consist of rams, thus allowing these rams to be controlled remotely. Any variant for the remote operation of the steering actuators 11 from the following vehicle 2 may be envisioned (transmission by cable, electrical or electromechanical transmission, etc.).

The following vehicle 2 additionally comprises a steering computer 17 designed to control the yaw-direction steering of the following vehicle 2 by action on the steering actuator 18.

The steering computer 17 is tasked with steering the following vehicle 2 in such a way that the path of the following vehicle 2 falls within the safe path cleared by the weight-based mine-clearing system 4. The steering computer 17 is thus connected for example to sensors relating to the handling of the steering wheel 20 or the actuation of the actuators 11, or for example to sensors indicative of the position of the chassis 7 relative to the following vehicle 2, or any other element that allows the steering computer 17 to know the path of the weight-based mine-clearing system 4 and notably of its wheelsets 5. On the basis of this information, the steering computer 17 steers the following vehicle 2 in such a way that its wheels follow a path that falls inside the lane made safe by the weight-based mine-clearing system 4.

The driver of the following vehicle 2 therefore commands the path of the convoy 1 as a whole by acting on the yaw-direction steering command for the weight-based mine-clearing system 4, and manages the rate of advance of the convoy 1 as a whole by acting on the rate of advance (acceleration, speed, braking) of the following vehicle 2.

This third embodiment may of course also be implemented with the variant corresponding to FIG. 2 as to how the yaw-direction steering of the weight-based mine-clearing system 4 is commanded.

Figure 8:
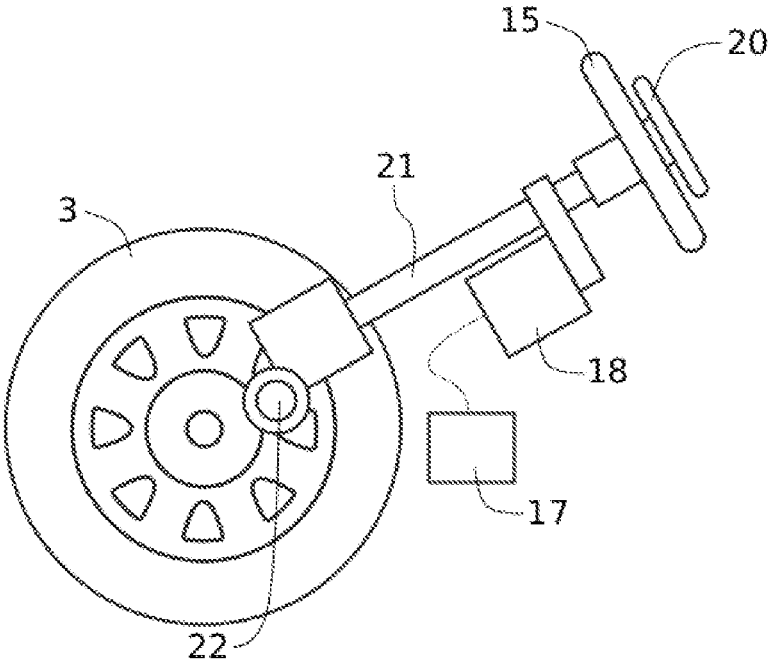
FIG. 8 schematically illustrates the driving station of the following vehicle of the convoy of FIG. 7.

FIG. 8 illustrates an example of how means for driving the following vehicle 2 are embodied for the third embodiment of FIG. 7.

The driver of the following vehicle 2 according to this example has available to them in the driving post two steering wheels 15, 20 which are mounted concentrically but independently of one another.

During phases in which the convoy 1 is outside a danger zone and the weight-based mine-clearing system 4 is deactivated, the driver of the following vehicle 2 drives the vehicle in the conventional way using the steering wheel 15 (the steering actuator 18 and the steering computer 17 being deactivated).

During phases passing through danger zones, the weight-based mine-clearing system is activated and the driver of the following vehicle 2 controls the yaw-direction steering of the weight-based mine-clearing system 4 by acting on the steering wheel 20, whereas the steering computer 17 assumes responsibility for controlling the steering actuator 18 (which in this instance is a rotary actuator) in mesh with the steering column 21 and therefore acting on the steering rack 22.

The driver of the following vehicle 2 acts only on the steering wheel 20 but can at any moment take back control of the steering of the following vehicle 2, if need be, either temporarily or permanently, by direct action on the steering wheel 15.

The driver of the following vehicle 2 may manually deactivate the automatic actuation of the steering of the vehicle, or the steering wheel 15 may be equipped with a sensor that detects action by the driver on the steering wheel 15 and in response deactivates the automatic actuation.

In all of the embodiments of the invention, during phases of use of the weight-based mine-clearing system 4, the path of the convoy 1 is defined by the weight-based mine-clearing system 4, whether this be automatically (first and second embodiments) or manually through action by the driver of the following vehicle (third embodiment). The yaw direction of the following vehicle 2 is steered only in response to the path taken by the weight-based mine-clearing system 4. Not only is the path of the following vehicle 2 achieved in response to the path of the weight-based mine-clearing system 4, but also, each yaw-direction command of the following vehicle 2 chronologically follows the yaw-direction command of the weight-based mine-clearing system 4. This ensures that the following vehicle 2 unavoidably has the ability to follow the wheeltracks of the weight-based mine-clearing system 4 with no uncertainty as to the lane made safe by the weight-based mine-clearing system 4. The following vehicle 2 keeps its path within a safe lane that has already been created at the time at which the yaw-direction steering commands relating to this vehicle need to be determined.

Variant embodiments of the invention may be implemented. In particular, the examples described relate to a following vehicle having four wheels, two of them steered, it being appreciated that the invention applies equally to any following vehicle equipped with other configurations and numbers of wheels and steered wheels, just as it applies to other configurations of wheels such as caterpillar tracks.

The invention also applies to a convoy in which the following vehicle is not physically coupled to the weight-based mine-clearing system but simply follows it at a distance.

The invention claimed is:

1. A method for steering a convoy (1) comprising a following vehicle (2) to be protected and a weight-based mine-clearing system (4), the method comprising the following steps:

steering a yaw-direction steering command of the weight-based mine-clearing system (4) on the basis of a route to be followed, the weight-based mine-clearing system (4) defining a lane made safe by the passage of at least one wheelset (5) designed to apply pressure to the ground;

steering the following vehicle (2) so wheels follow a path falling inside said safe lane defined by the weight-based mine-clearing system (4);

wherein the step of steering the following vehicle (2) comprises a step of commanding the yaw direction of the following vehicle (2) by a steering actuator (18) of the following vehicle (2), the steering actuator (18) being commanded by a steering computer (17) connected to at least one environment sensor (19) of the following vehicle (2) and designed to steer the path of the following vehicle (2) so that the wheels of the following vehicle (2) fall inside the safe lane defined by the weight-based mine-clearing system (4).

2. The method as claimed in claim 1, wherein the step of steering a yaw-direction command of the weight-based mine-clearing system (4) is performed by a steering computer (12) determining said route to be followed.

3. The method as claimed in claim 2, wherein the yaw-direction steering command of the weight-based mine-clearing system (4) is executed by a steering actuator (10, 11) connected to the steering computer (12).

4. The method as claimed in claim 2, wherein the steering computer (12) determines the route to be followed on the basis of an environmental factor.

5. The method as claimed in claim 4, wherein said environmental factor is the configuration of a pathway.

6. The method as claimed in claim 4, wherein said environmental factor is a line drawn on the ground.

7. The method as claimed in claim 2, wherein the step of steering the following vehicle (2) is performed by a driver of the following vehicle (2).

8. The method as claimed in claim 7, wherein the driver of the following vehicle (2) steers only the following vehicle (2).

9. The method as claimed in claim 1, wherein:

the step of steering a yaw-direction command of the weight-based mine-clearing system (4) is performed from the following vehicle (2) by a driver of the following vehicle (2);

the step of steering the following vehicle (2) comprises a step of commanding the yaw direction of the following vehicle (2) achieved by a steering actuator (18) of the following vehicle (2), commanded by a steering computer (17) designed to steer the path of the following vehicle (2) so the wheels of the following vehicle (2) fall inside the safe lane defined by the weight-based mine-clearing system (4).

10. A convoy (1) to implement the steering method according to claim 1, comprising a following vehicle (2) that is to be protected and a weight-based mine-clearing system (4) provided with at least one wheelset (5) designed to apply pressure to the ground to define a lane that has been made safe and provided with a commanding device for the yaw direction, the commanding device for the yaw direction of the weight-based mine-clearing system (4) comprise a steering computer (12) connected to at least one environment sensor (13) and designed to determine the route to be followed on the basis of an environmental factor and to steer the weight-based mine-clearing system (4) to the yaw-direction steering command, on the basis of a route to be followed, and wherein the following vehicle (2) comprises a steering actuator (18) commanded by a steering computer (17) designed to steer the path of the following vehicle (2) so that wheels of the following vehicle (2) fall inside the safe lane defined by the weight-based mine-clearing system (4).

11. The convoy as claimed in claim 10, wherein the environment sensor (13) determines the configuration of a pathway.

12. The convoy as claimed in claim 10, wherein the environment sensor (13) identifies a line drawn on the ground.

13. The convoy as claimed in claim 10, wherein the following vehicle (2) comprises a manual steering-control device designed so that a driver of the following vehicle (2) can command a yaw direction of the following vehicle (2).

14. The convoy as claimed in claim 10, wherein the following vehicle (2) comprises at least one environment sensor (19) connected to the steering computer (17).

15. A convoy (1) to implement the steering method according to claim 1 comprising a following vehicle (2) to be protected and a weight-based mine-clearing system (4) provided with at least one wheelset (5) to apply pressure to the ground to define a lane that has been made safe and provided with a commanding device for commanding the yaw direction, wherein:

the commanding device comprises a steering actuator (11) for commanding the yaw-direction of the weight-based mine-clearing system (4) from the following vehicle (2);

the following vehicle (2) comprises a manual devicde (20) for commanding said steering actuator (11) of the weight-based mine-clearing system (4);

the following vehicle (2) comprises a steering actuator (18) commanded by a steering computer (17) connected to at least one environment sensor (19) to steer the path of the following vehicle (2) so that the wheels of the following vehicle (2) fall inside the safe lane defined by the weight-based mine-clearing system (4).

16. The convoy as claimed in claim 15, wherein the following vehicle (2) comprises:

a first steering wheel (20) constituting the manual device (20) for commanding said steering actuator (11) of the weight-based mine-clearing system (4);

a second steering wheel (15) designed for taking control of the steering actuator (17) of the following vehicle (2).

* * * * *